US009180333B2

(12) United States Patent
DiPace et al.

(10) Patent No.: US 9,180,333 B2
(45) Date of Patent: Nov. 10, 2015

(54) STRENGTH TRAINING AID

(75) Inventors: Daniel DiPace, Palm City, FL (US); Michael Cristoforo, Palm City, FL (US)

(73) Assignee: Get Arm Strength L.L.C., Palm City, FL (US)

( * ) Notice: Subject to any disclaimer, the term of this patent is extended or adjusted under 35 U.S.C. 154(b) by 192 days.

(21) Appl. No.: 13/988,032

(22) PCT Filed: May 2, 2012

(86) PCT No.: PCT/US2012/036115
§ 371 (c)(1),
(2), (4) Date: Feb. 7, 2014

(87) PCT Pub. No.: WO2012/151273
PCT Pub. Date: Nov. 8, 2012

(65) Prior Publication Data

US 2014/0141943 A1 May 22, 2014

Related U.S. Application Data

(60) Provisional application No. 61/481,537, filed on May 2, 2011.

(51) Int. Cl.
*A63B 21/00* (2006.01)
*A63B 21/06* (2006.01)
*A63B 21/055* (2006.01)
(Continued)

(52) U.S. Cl.
CPC ..... *A63B 21/0603* (2013.01); *A63B 15/00* (2013.01); *A63B 21/00061* (2013.01); *A63B 21/0552* (2013.01); *A63B 21/0555* (2013.01); *A63B 21/0557* (2013.01); *A63B 21/1484* (2013.01); *A63B 21/28* (2013.01); *A63B 23/03508* (2013.01); *A63B 69/002* (2013.01); *A63B 69/0002* (2013.01); *A63B 69/0079* (2013.01); *A63B 69/3632* (2013.01); *A63B 21/1469* (2013.01); *A63B 23/0355* (2013.01);
(Continued)

(58) Field of Classification Search
CPC ..... A63B 21/00
USPC ..... 482/49, 126, 904, 79, 80, 121
See application file for complete search history.

(56) References Cited

U.S. PATENT DOCUMENTS

| | | | | | |
|---|---|---|---|---|---|
| 2,921,743 | A | * | 1/1960 | Westover et al. | 239/723 |
| 2,944,817 | A | * | 7/1960 | Stiller | 473/424 |
| 3,212,777 | A | * | 10/1965 | Spoczynski | 482/82 |
| 4,505,474 | A | * | 3/1985 | Mattox | 482/82 |
| 5,709,637 | A | | 1/1998 | Gow et al. | |

(Continued)

FOREIGN PATENT DOCUMENTS

| | | |
|---|---|---|
| DE | 202007017889 | 3/2008 |
| WO | WO2008122197 | 10/2008 |
| WO | WO2012151273 | 11/2012 |

*Primary Examiner* — Jerome w Donnelly
(74) *Attorney, Agent, or Firm* — McHale & Slavin, P.A.

(57) ABSTRACT

The present invention relates to a portable strength training device which can be adapted to various sports and can be utilized in almost any location. More, specifically present invention is a weighted elongated tubular member which includes connectors for attachment of various balls and/or sporting equipment. The training device is adjustable through the use of various sized hollow tubes of different lengths and/or diameters which allow for the addition of one or more types of weight material within the hollow lumen. Various different sports objects, such as balls, golf club handles, tennis racket handles, baseball bats and the like can be secured to one of the distal ends of the hollow tubes. Clips hooks or the like may be secured to the opposite distal end of the tube for anchoring the device.

19 Claims, 6 Drawing Sheets

(51) Int. Cl.

| | |
|---|---|
| ***A63B 21/28*** | (2006.01) |
| ***A63B 23/035*** | (2006.01) |
| ***A63B 69/00*** | (2006.01) |
| ***A63B 69/36*** | (2006.01) |
| ***A63B 15/00*** | (2006.01) |

(52) U.S. Cl.
CPC ..... *A63B 2069/0006* (2013.01); *A63B 2209/00* (2013.01); *A63B 2243/00* (2013.01)

(56) References Cited

U.S. PATENT DOCUMENTS

| | | | | |
|---|---|---|---|---|
| 5,755,630 | A | 5/1998 | Malwitz | |
| 6,837,808 | B1 | 1/2005 | Hatch | |
| 2002/0013599 | A1 | 1/2002 | Limon et al. | |
| 2003/0109324 | A1 | 6/2003 | Novotny | |
| 2004/0235624 | A1 * | 11/2004 | Bruce | 482/125 |

* cited by examiner

STRENGTH TRAINING AID

CROSS REFERENCE TO RELATED APPLICATIONS

This is a national stage filing in accordance with 35 U.S.C. §371 of PCT/US2012/036115, filed May 2, 2012, which claims the benefit of the priority of U.S. Provisional Patent Application No. 61/481,537, filed May 2, 2011, entitled, "Strength Training Aid", the contents of which are incorporated herein in their entirety.

FIELD OF THE INVENTION

The present invention relates to the field of strength training devices, and in particular to a device that develops strength in the forearms, upper arms and shoulders. The present invention enables an individual to increase his/her strength and ability to participate in various sports.

BACKGROUND OF THE INVENTION

There are various devices for strengthening the hands, wrists, forearms, upper arms, back and shoulders. These devices operate on the principles of variable threading, tension, torque, and compression mechanisms. These devices range from simple spring like devices which are operated in one hand such as free weights to complicated machines which can develop multiple muscles and muscle groups simultaneously. Strength training devices are currently available for everyone from the casual athlete to the professional athlete. The strength training devices which the professional athletes use are usually complex, relatively expensive, and generally not available for the average person/athlete. Another problem with the strength training equipment that professional athletes use is that it is designed for a specific sport. An individual who wants to play multiple sports would need to purchase many different pieces of strength training equipment.

DESCRIPTION OF THE PRIOR ART

U.S. Pat. No. 5,709,637 discloses a portable exercise device for specific strength training of the rotator cuff. The device includes a cylindrical spool which has a handle across its diameter. A length of elastic tubing is secured tangentially to one point of the spool. The opposite end of the elastic tubing is securable to a fixed point or object. This permits an individual to grip the handle and rotate or move the spool against a continuous resistance for muscle development.

U.S. Published Patent Application No. 2002/013599 discloses a strength training device for developing the forearms, upper arms, and shoulder muscle groups. The device includes two cylindrical handles with fixed concave surface end caps that are connected by a cylindrical center joint piece. The center piece has a concave surface on top and an under body cavity on the bottom. One end of an exercise cord is secured to the center joint piece. The opposite end of the exercise cord is secured to free weights. The free weights are raised and lowered by an individual rotating the cylindrical handles toward their body and away from their body. Weight machine cables can also be secured to the center joint piece. This enables an individual to perform bicep curls and triceps extension exercises.

Therefore, there is a need in the strength training art to provide a device which is portable, adjustable, and easy to use. The training device should be relatively simple in construction and portable for easy transport and use at remote locations. The device should also be capable of adjustment for athletes having a range of strength ranging from beginning amateurs to professional athletes. The device should also be adaptable for use by athletes training for various sports without the need for complex tools or scores of auxiliary parts.

SUMMARY OF THE INVENTION

The present invention relates to a portable strength training device which can be adapted to various sports and can be utilized in almost any location. More, specifically present invention is a weighted elongated tubular member which includes connectors for attachment of various balls and/or sporting equipment. The training device is adjustable through the use of various sized hollow tubes of different lengths and/or diameters which allow for the addition of one or more types of weight material within the hollow lumen. Materials such as sand, lead shot, steel shot or the like can be utilized within the hollow tubes to increase or decrease the weight of the tubes. While materials such as rubber chunks, springs or the like that affect the action of the tube may be mixed with the weight material to vary the training provided by the device. Various different sports objects, such as balls, golf club handles, tennis racket handles, baseball bats and the like can be secured to one of the distal ends of the hollow tubes. Clips hooks or the like may be secured to the opposite distal end of the tube for anchoring the device. Handles or the like may be utilized in place of the clips or hooks to allow a second person to provide anchoring or action to the tube and thus the person training. In addition, the tube may be provided in a resilient elastic or non-elastic construction to add additional training options to the user. These various features enable the device to be tailored by an individual for various types of training and for different sports.

Accordingly, it is an objective of the present invention to provide a training device which can be utilized for training athletes involved in various sports.

It is a further objective of the present invention to provide a portable training device for various sports which can be readily used in many different locations.

It is yet another objective of the present invention to provide a portable training device for various sports which can be readily adjusted.

It is a still further objective of the present invention to provide a portable training device which can readily be adapted to different sports.

It is still a further objective of the present invention to provide a portable training device which can be readily adjusted to provide different resistance and/or weights.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
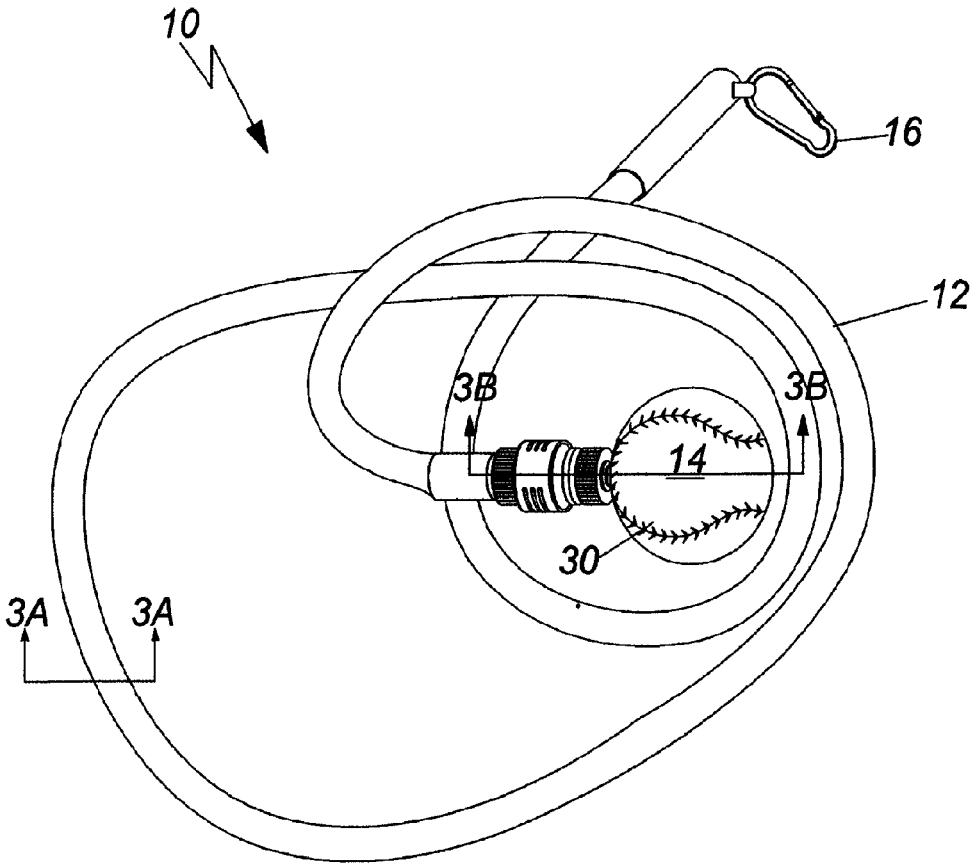
FIG. 1 is a perspective view of one embodiment of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
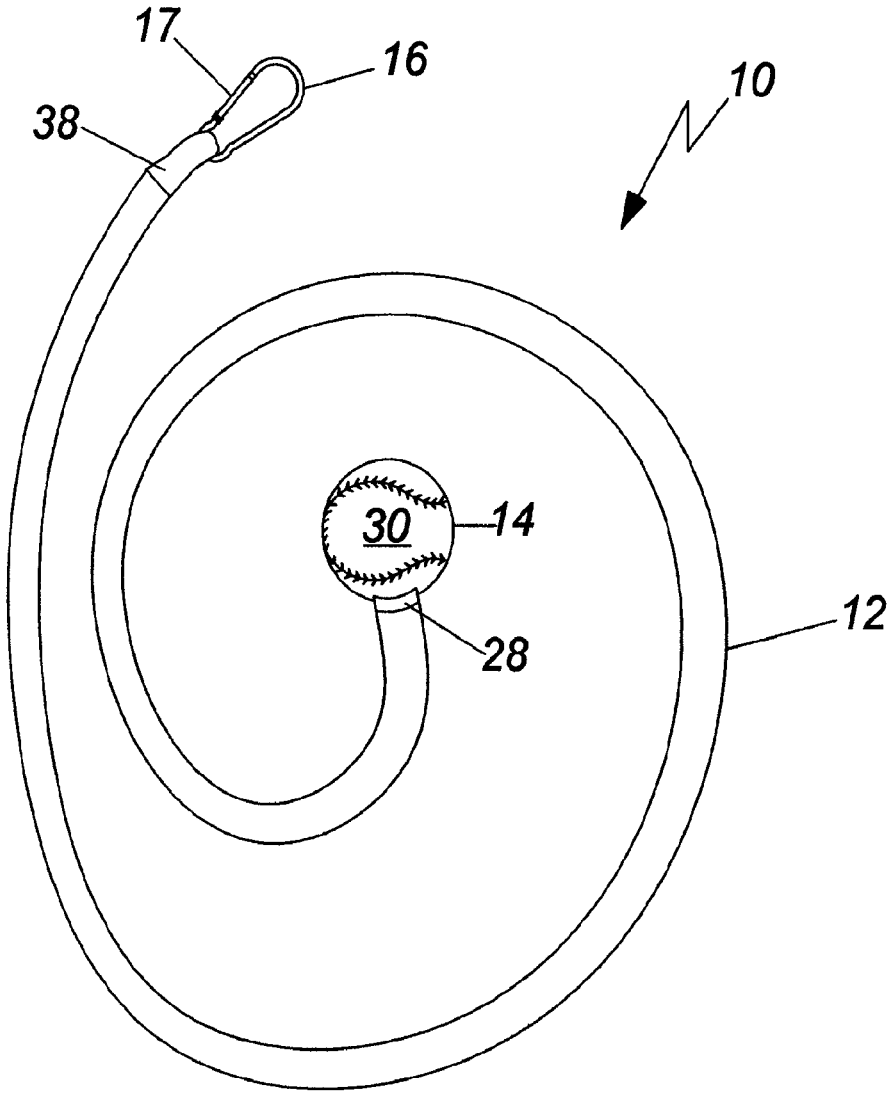
FIG. 2 is a perspective view of an alternative embodiment of the present invention.

FIGS. 1-4, which are now referenced, illustrate one embodiment of the present invention and the manner in which it is assembled. In general, the strength training device 10 comprises a hollow tubular member 12, a training object 14 removably secured to one end of the hollow tubular member 12, and a fastening device 16 secured to an opposite end of the hollow tubular member. More specifically, the hollow tubular member 12 is preferably made from a flexible, non-elastic material such as a reinforced rubber and may include various filler materials 13 which vary the weight and action provided by the tubular member. For example, sand alone may be added to give one weight and a relatively dead action to the tubular member. Alternatively, a filler such as steel shot may be combined with rubber particles or beads to result in a different weight and substantially more action provided by the tubular member. Various other combinations of materials may be added singularly or combination to allow the athlete to tailor his training to his particular needs. In this manner, the athlete may train for strength, speed agility, dexterity and the like with a single training tool by altering its properties. In the embodiment illustrated in FIGS. 1-4 the training object 14 is illustrated as a baseball 30 is secured to one end of the hollow tubular member. The ball may be directly adhered to the tubular member as illustrated in FIG. 2 or alternatively and preferably, a swiveling quick release coupling 20 may be provided to allow the user to change training objects 14. The quick release coupling 20 preferably includes a ring 22, button or the like which may be slid or moved to release the training object from the distal end of the tubular member 14. The training object 14 preferably includes a stem 24 secured to the training object via threaded stud 26, adhesive 28 or the like. The stem 24 is generally constructed and arranged to cooperate with the quick release coupling 20 to create an operator securable connection and release. A filler cap 28 may be secured to or formed as portion of the quick release to facilitate access to the lumen 18. In a preferred embodiment, the filler cap cooperates with a threaded terminal 32. The threaded terminal includes a sleeve 34 which cooperates with the outer or inner surface of the tubular member for attachment thereof. A fastening device 16, such as a carabiner 17, hook or the like is secured to an opposite end or second end 38 of the tubular member 14 to allow the person training to secure the second end of the tubular member to a fixed object. In operation, an individual would secure the carabiner 17 to a fixed object. Afterwards the trainee can simulate throwing, pitching or catching the ball. The additional weight of the hollow tubular member helps to strengthen the muscles associated with throwing, pitching or catching the ball. The carabiner secures the hollow tubular member to a stationary object so that it will not fly around when in use. Also, securing the training device to a stationary object prevents the training object from being thrown away or hitting another individual. The trainee can alter the properties of the tubular member by adding or deleting fillers within the tube.

Figure 3A:
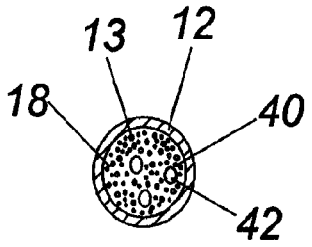
FIG. 3A is a cross sectional view taken along lines 3A-3A of FIG. 1, illustrating the hollow tubular member of the present invention.
Figure 3B:
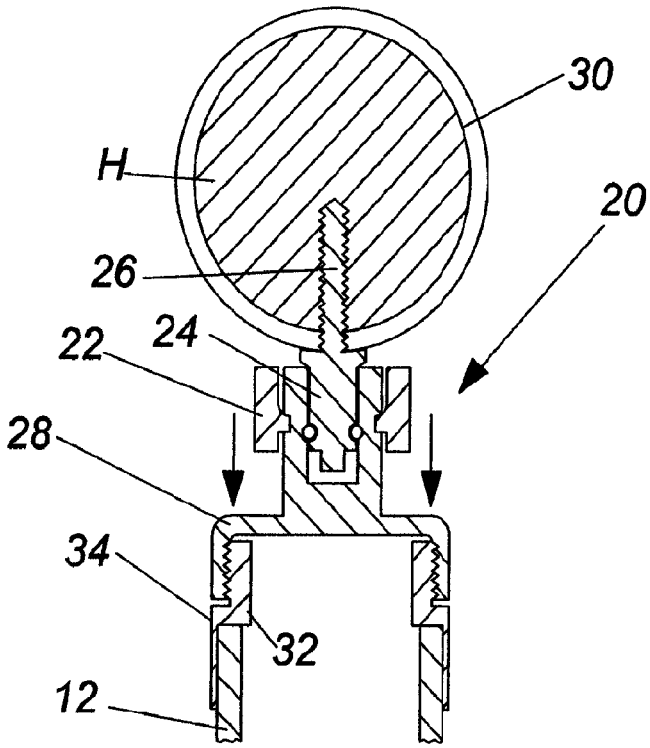
FIG. 3B is a cross sectional view taken along lines 3B-3B of FIG. 1, illustrating the quick release connection between a ball and the hollow tubular member.
Figure 4:
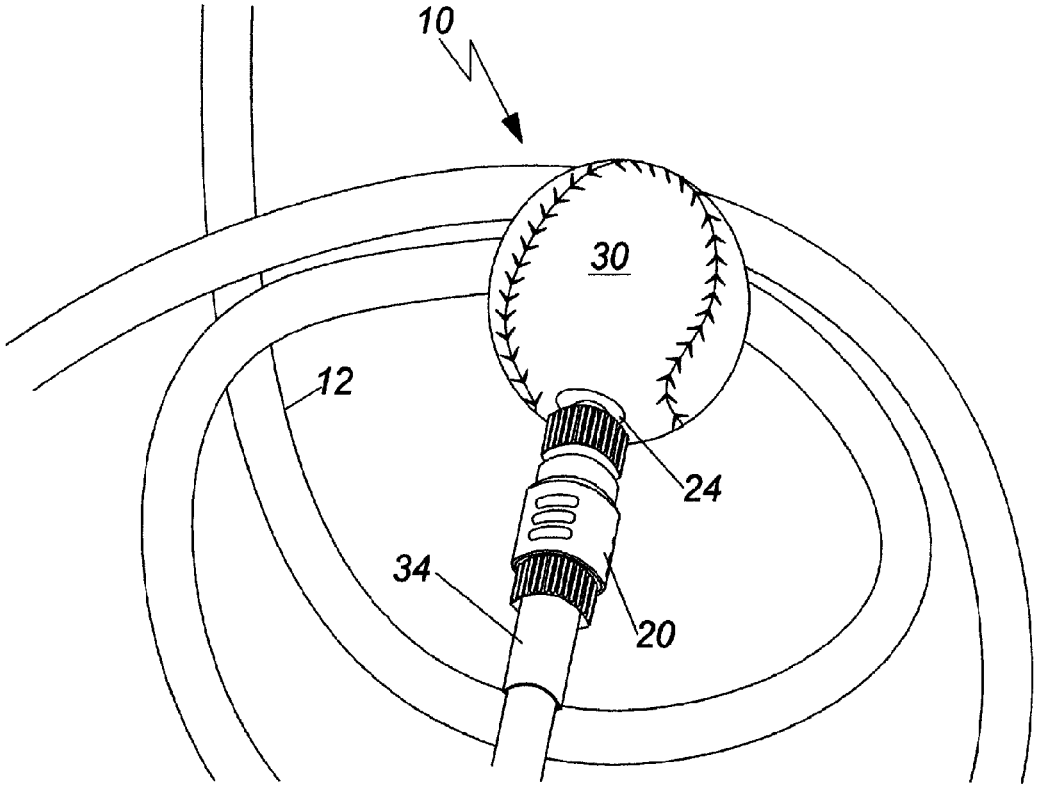
FIG. 4 is a partial perspective view of the embodiment illustrated in FIG. 1.

Referring to FIG. 3A, a cross sectional view illustrating the hollow tubular member 12 partially filled with a filler material 13 for modifying the properties of the tubular member. The preferred substance is a granular material characterized by a loss of energy whenever the particles collide such as sand. However, other substances can be employed, such as lead shot, BB's, crushed shells, crushed gravel and the like. Other suitable materials include materials suitable for absorbing energy, some of which may be released by causing a secondary motion in the tubular member, examples include, but should not be limited to, rubber chunks, springs, water, and other fluids. The only criteria for the filler materials 13 are that they can generally flex and/or conform to the shape of the lumen within the hollow tubular member 12. FIG. 3 illustrates the hollow tubular member 12 being filled with sand 40 and rubber 42. The amount of the substance utilized in the present invention depends on the additional weight and type of action resulting from movement an individual wants to add to the training object. The hollow tubular member 12 can be completely empty, partially full, or completely full of filler 13. While the preferred embodiment of the hollow tubular member is flexible and non-elastic, it can also be made from an elastic material whereby all or portions of the tubular member are allowed to elastically expand or stretch.

While subject to the trainee's preferences, when the training object is relatively small, such as a baseball or a softball, the amount of filler 13 added to the hollow tubular member is relatively small. When the training object is relatively large, such as a basketball or soccer ball, the amount of filler 13 added is relatively large. For example, when a basketball is utilized the individual will simulate shooting the basketball or passing the basketball. The repetitive throwing or handling motion of the training object results in an increase in the strength of an individual performing these motions. Additionally, the amount of filler 13 in the hollow tubular member 12 can be increased as the individual progresses in their training. This will present additional resistance during the training sessions and lead to an increase in strength. This is similar to adding weights to certain exercises in weight training.

While the preferred embodiment illustrates a baseball as the training object 14 utilized with the training device 10, other objects can also be employed. For example, a softball, a basketball, a soccer ball, or a football. Additionally, objects such as a straight bar, a curved bar, or a handle can also be secured to the hollow tubular member. These additional training objects can be utilized to develop specific muscle or muscle groups related to tennis, golf, racquetball, baseball or any other sport which requires the player to swing an elongated instrument.

Figure 5:
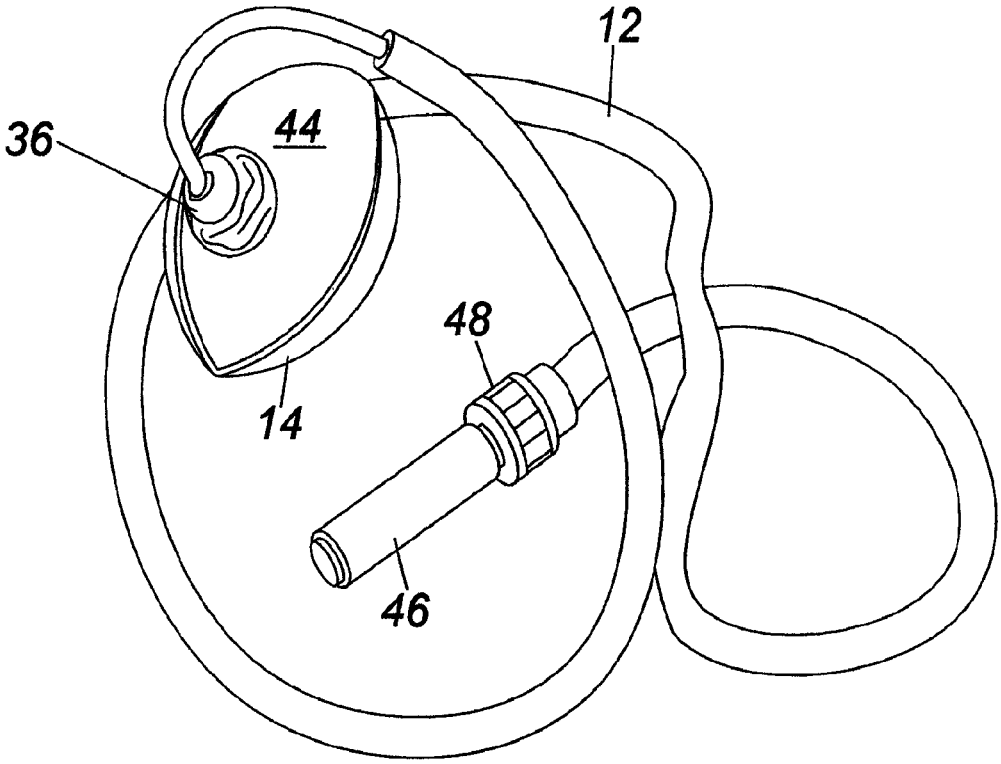
FIG. 5 is a perspective view of an alternative embodiment of the present invention.

Referring to FIG. 5, a perspective view of an alternative embodiment of the present device is illustrated. In this embodiment, the first end 36 of the tubular member 12 is secured directly to the training object 14, illustrated herein as a football 44. Attached to the second end 38 of the tubular member is a hand grip 46 and swivel 48. Also in this embodiment, the swivel is removably secured to the second end of the tubular member to allow the lumen of the tubular member to be filled to alter its workout properties as described above. The hand grip 46 provides the ability for a second person to provide motion or tension to the tubular member for additional training.

Figure 6:
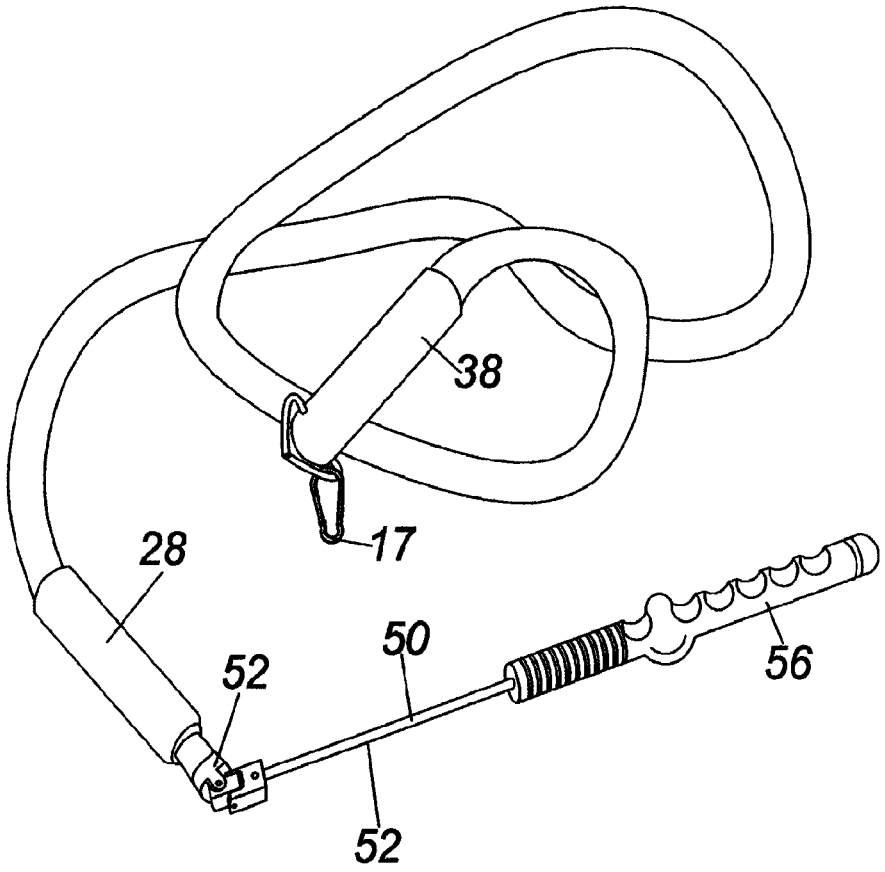
FIG. 6 is a perspective view of an alternative embodiment of the present invention.

Referring to FIG. 6, a perspective view of an alternative embodiment of the present device is illustrated. In this embodiment, the first end 36 of the tubular member 12 is secured directly to the training object 14, illustrated herein as a golf club shaft 50. Attached between the first end 36 of the tubular member and the golf club shaft 50 is a universal swivel 52. The universal swivel is constructed and arranged to flex in a polyaxial manner as well as swivel in a planer manner. The universal swivel is removably secured to the filler cap 28 of the tubular member to allow the lumen of the tubular member to be filled to alter its workout properties as described above. A carabiner 17 is secured to the second end 38 of the tubular member for securing the tubular member to a fixed object. It should be noted that while a golf club shaft is illustrated, a baseball/softball bat, tennis racket handle, racquet ball racket or the like having a substantially rigid elongated shaft with a hand grip 56 mounted at a distal end thereof may be utilized without departing from the scope of the invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A strength training device comprising:

an elongated tubular member constructed from a flexible non-elastic material, said tubular member having a first end and a second end, said first end fixedly attached to a sports training object, said second end including a fastener member secured thereto, said fastener member constructed and arranged for removably securing said second end of said tubular member to a fixed object, said tubular member having a lumen extending axially along said tubular member between said first end and said second end, said lumen including a plug at one end and a cap at the other for adding filler material to said lumen, said lumen at least partially filled with a filler material constructed and arranged to alter the weight of said tubular member, whereby said second end of said tubular member may be secured to a fixed object and said sports training object manipulated by a user for strength training related to said sports training object.

2. The strength training device of claim 1 wherein said first end of said tubular member is removably secured to said sports training object.

3. The strength training device of claim 2 wherein said first end of said tubular member includes a first portion of a quick release coupling, said sports training object including the second portion of said quick release coupling, whereby said first portion and said second portion of said quick release coupling are constructed and arranged for repeated coupling and release between said tubular member and said sports training object.

4. The strength training device of claim 3 wherein said first portion of said quick coupling includes a moveable member for engaging and releasing a stem secured to said sports training object, whereby said sports training object can swivel about said stem when connected to said first portion of said quick release coupling.

5. The strength training device of claim 3 wherein a portion of said first portion of said quick release coupling includes said cap for altering the contents of said lumen.

6. The strength training device of claim 1 wherein said fastener secured to said second end of said tubular member is a carabiner.

7. The strength training device of claim 1 wherein said fastener secured to said second end of said tubular member is a hook.

8. The strength training device of claim 1 wherein said flexible non-elastic material is fiber reinforced rubber.

9. The strength training device of claim 1 wherein said filler material is a solid granular material characterized by a loss of energy whenever the granules of the material collide.

10. The strength training device of claim 9 wherein said filler material is selected from the group consisting of sand, metal shot, crushed polymers, and crushed minerals.

11. The strength training device of claim 1 wherein said filler material is characterized by the ability to absorb energy, some of which may be released to cause a secondary motion in said tubular member.

12. The strength training device of claim 11 wherein said filler material is selected from the group consisting of rubber, spring material, and fluid.

13. The strength training device of claim 1 wherein said filler material is a combination of granular material characterized by a loss of energy whenever the granules of the material collide and a material characterized by the ability to absorb energy, some of which may be released to cause a secondary motion in said tubular member.

14. The strength training device of claim 1 wherein said sports training object is a ball.

15. The strength training device of claim 1 wherein said first end of said tubular member includes a universal swivel, a first end of said universal swivel secured to said first end of said tubular member a second end of said universal swivel secured to an elongated shaft having a grip at a distal end thereof.

16. The strength training device of claim 15 wherein said elongated shaft is a golf club shaft.

17. The strength training device of claim 15 wherein said elongated shaft is a portion of a baseball bat.

18. The strength training device of claim 1 wherein said second end of said tubular member includes a hand grip secured thereto.

19. The strength training device of claim 18 including a swivel mechanism secured between said hand grip and said second end of said tubular member.

* * * * *